US006244283B1

(12) United States Patent
Ou

(10) Patent No.: US 6,244,283 B1
(45) Date of Patent: Jun. 12, 2001

(54) UMBRELLA WITH CONNECTORS

(76) Inventor: Yang Wei Ou, No. 24, Alley 47, Lane 115, Sec. 2, Cheng Kung Rd., Taipei (TW)

( * ) Notice: Subject to any disclaimer, the term of this patent is extended or adjusted under 35 U.S.C. 154(b) by 0 days.

(21) Appl. No.: 09/356,907

(22) Filed: Jul. 20, 1999

(51) Int. Cl.[7] ..... A45B 15/00
(52) U.S. Cl. ..... 135/15.1; 135/33.41; 135/33.5
(58) Field of Search ..... 135/15.1, 19.5, 135/33.41, 33.5

(56) References Cited

U.S. PATENT DOCUMENTS 588,773 * 8/1897 Mitchell .
886,426 * 5/1908 Shivers .
940,346 * 11/1909 Morton .
975,203 * 11/1910 Birdsall .
1,145,768 * 7/1915 Hartfiel .
2,230,640 * 2/1941 Feller .
3,429,320 * 2/1969 Edelkind .
3,873,821 * 3/1975 Larson .
4,061,154 * 12/1977 Cox et al. .
4,979,535 * 12/1990 Sadowski et al. .
5,068,955 * 12/1991 Gonet ..... 135/15.1 X
5,085,239 * 2/1992 Chin-Hung et al. ..... 135/33.41 X

* cited by examiner

*Primary Examiner*—Robert W. Gibson, Jr.
(74) *Attorney, Agent, or Firm*—Rosenberg, Klein & Lee

(57) ABSTRACT

An umbrella comprising a shank, a handle, a rib, multiple tip beads, a canopy, and a ferrule is characterized by a series of connectors which are installed at least between the handle and the shank, between the tip beads and the rib, between the canopy and the rib, and between the ferrule and the shank. Users can change various shapes and colors of canopies, tip beads, handles, and ferrules to assemble new umbrellas through simple lock and insertion operation.

2 Claims, 8 Drawing Sheets

UMBRELLA WITH CONNECTORS

FIELD OF THE INVENTION

The present invention relates to an umbrella, more particularly, to an umbrella which can change the canopy, the tip beads, the handle, and the ferrule through simple operations.

BACKGROUND OF THE INVENTION

The object of present invention is to provide an umbrella which can change the canopy, the tip beads, the handle, and the ferrule through simple operations. The present invention comprising a shank, a handle, a rib, tip beads, a canopy, and a ferrule is characterized by a series of connectors which are installed between the handle and the shank, between the tip beads and the rib, between the canopy and the rib, and between the ferrule and the shank. Users can change various shapes and colors of canopies, tip beads, handles, and ferrules to assemble new umbrellas through simple lock and insertion operation.

The various objects and advantages of the present invention will be more readily understood from the following detailed description when read in conjunction with the appended drawing, in which:

DETAILED DESCRIPTION OF PREFERRED EMBODIMENT

Figure 1A:
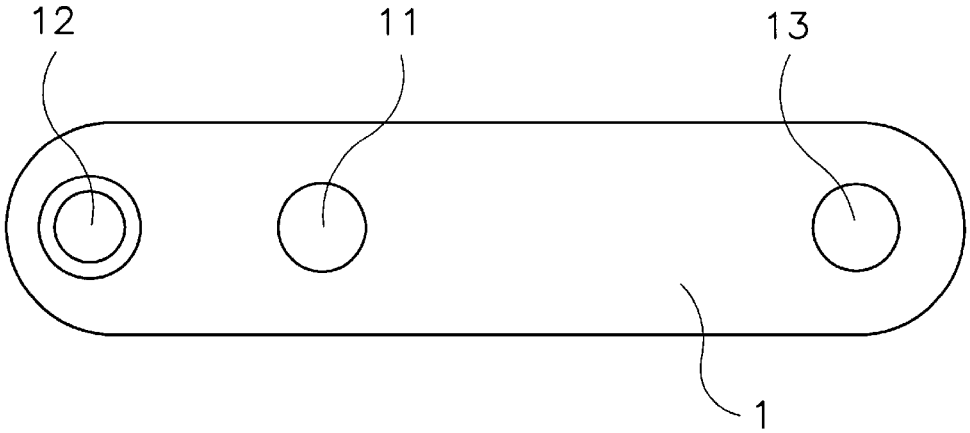
FIG. 1*a* is the front view of the connector between the canopy and the rib according to an embodiment of the present invention.
Figure 1B:
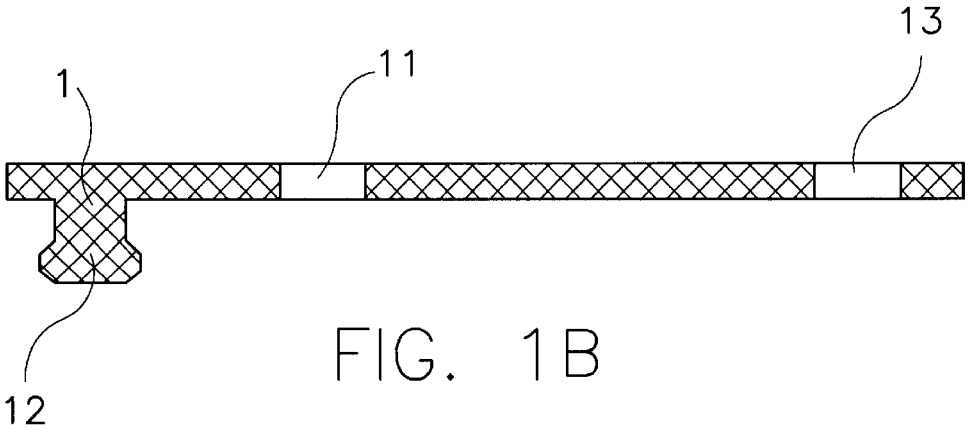
FIG. 1*b* is profile diagram of the connector between the canopy and the rib according to an embodiment of the present invention.
Figure 2:
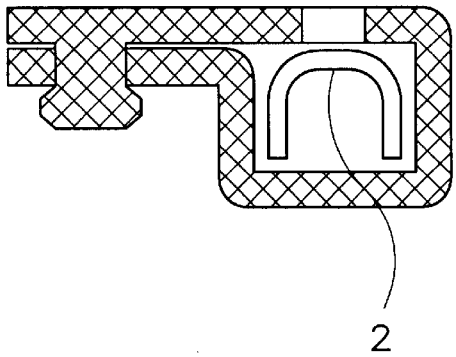
FIG. 2 is the diagram showing the connection between the canopy and the rib according to an embodiment of the present invention.

As shown in FIGS. 1*a*, 1*b*, and 2, the present invention provides an umbrella of which a connector 1 between a canopy and a rib 2 is an elastic plate. The connector 1 is sewed on the canopy through a hole 11 or is fixed on the canopy by other means. The connector 1 has a bump 12 and a hole 13. One end of the connector 1 connects to the other end with the bump 12 engaging the hole 13 so that the connector 1 circumscribes the rib 2. The canopy and the rib can thus be positioned accurately.

Figure 4:
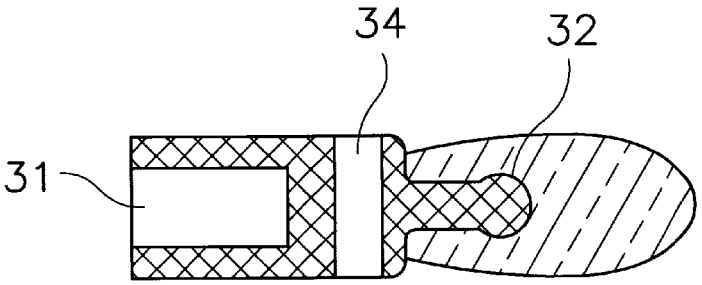
FIG. 4 is the diagram showing the connection between the tip bead and the rib according to an embodiment of the present invention.
Figure 3A:
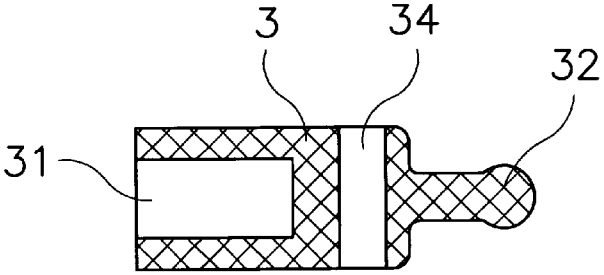
FIG. 3*a* is the profile diagram of the connector between the tip bead and the rib according to an embodiment of the present invention.
Figure 3B:
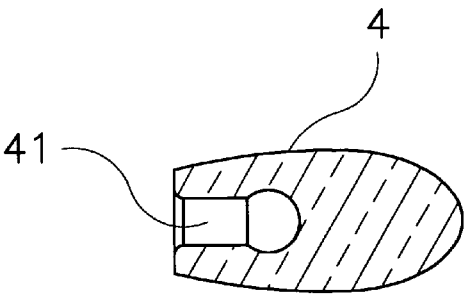
FIG. 3*b* is the profile diagram of the tip bead according to an embodiment of the present invention.
Figure 6:
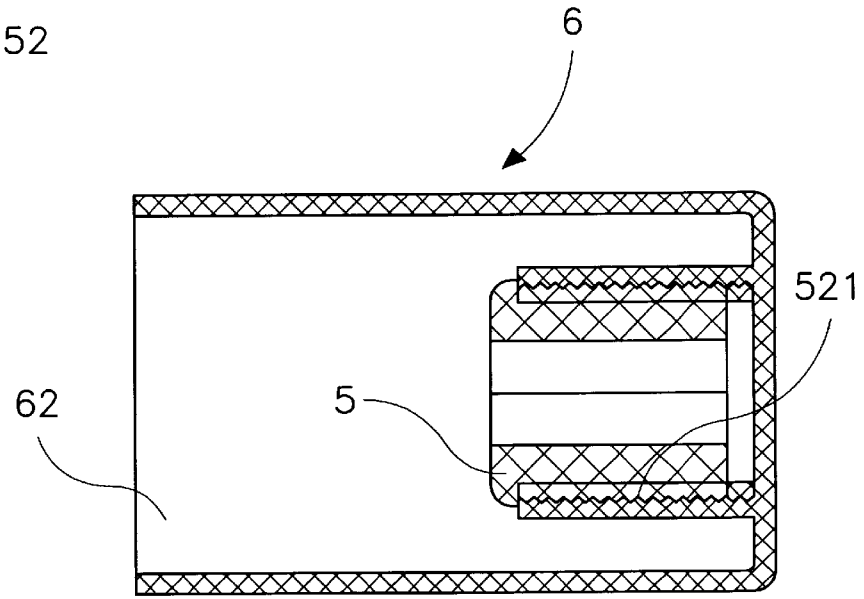
FIG. 6 is the diagram showing the connection between the shank and the handle of a collapsible umbrella according to an embodiment of the present invention.
Figure 5A:
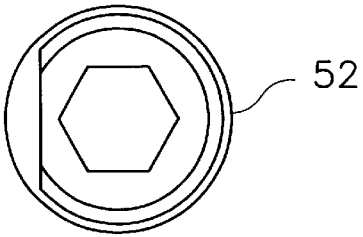
FIG. 5*a* is the front view of the connector between the handle and the shank of a collapsible umbrella according to an embodiment of the present invention.
Figure 5B:
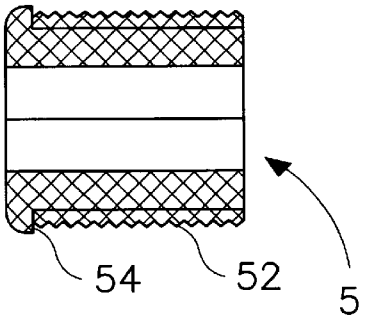
FIG. 5*b* is the profile diagram of the connector between the handle and the shank of a collapsible umbrella according to an embodiment of the present invention.
Figure 5C:
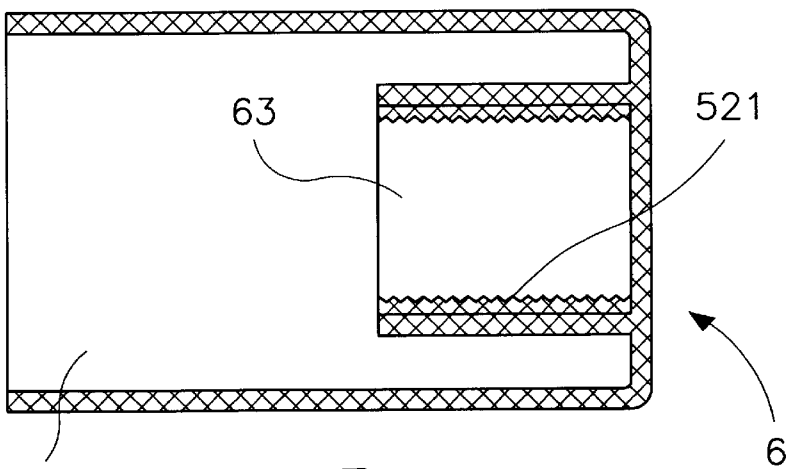
FIG. 5*c* is the profile diagram of the handle of an collapsible umbrella according to an embodiment of the present invention.

As shown in FIGS. 3*a*, 3*b*, and 4, the present invention provides an umbrella of which a connector 3 between a tip bead 4 and the rib is a short bar. The connector 3 is sewed on the canopy through a hole 34 or is fixed on the canopy by other means. The connector 3 has a hole 31 on one end to insert the rib and a bump 32 of semi-sphere shape on the other end. The tip bead 4 has a hole 41 on one end to buckle up the bump 32. With the bump 32 of the connector 3 buckling up the hole 41 of the tip bead 4, the tip bead 4 is fixed on the rib. The tip bead, the rib, and the canopy can thus be positioned accurately.

As shown in FIGS. 5*a*, 5*b*, 5*c*, and 6, the present invention provides an umbrella of which a connector 5 between a handle 6 of a collapsible umbrella and a shank is a hollow bar with a lock side 54 on one end. The connector 5 has an outer thread 52. The handle 6 of a collapsible umbrella is a bar with an open 62 on one end and a mount groove 63 on the inner bottom. The mount groove 63 has an inner thread 521. The outer thread 52 of the connector 5 is screwed with the inner thread 521 and the lock side 54 stops against the mount groove 63. The handle 6 of a collapsible umbrella, the connector 5, and the shank can thus be positioned accurately.

Figure 7A:
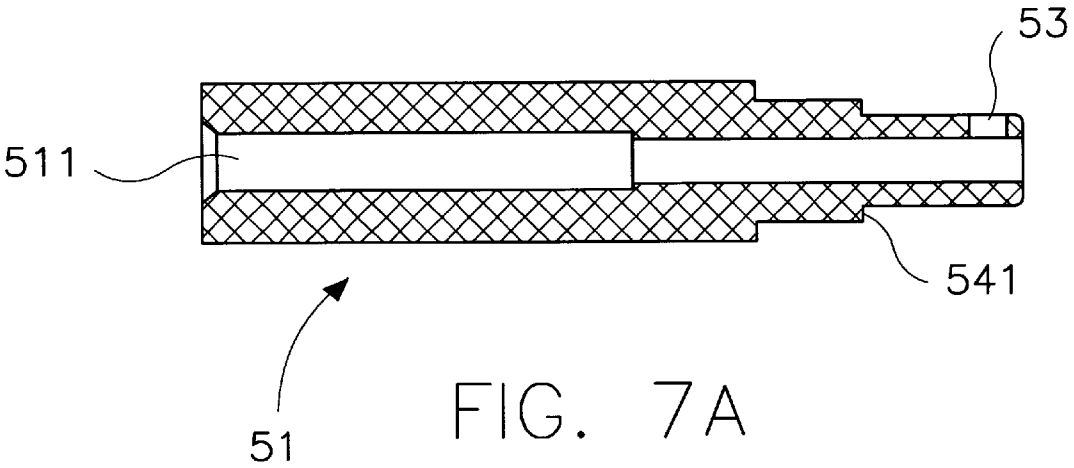
FIG. 7*a* is a side profile diagram of the connector between the handle and the shank of a stick umbrella according to an embodiment of the present invention.
Figure 7B:
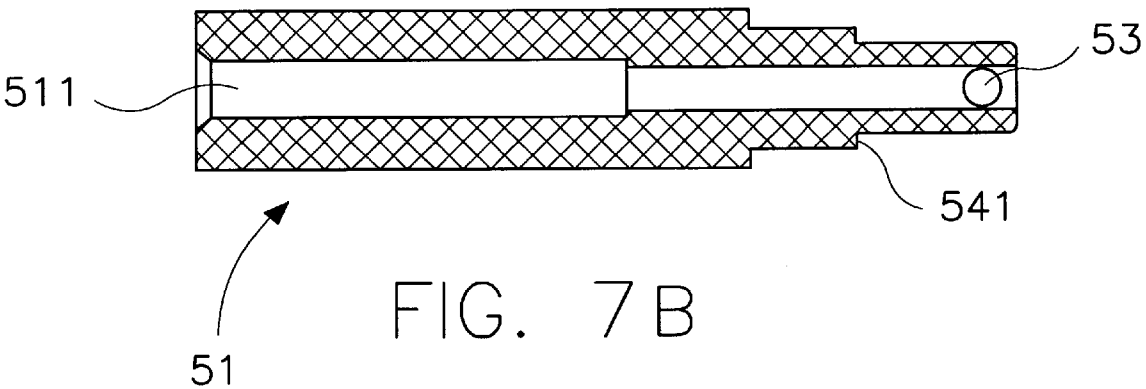
FIG. 7*b* is another side profile diagram of the connector between the handle and the shank of a stick umbrella according to an embodiment of the present invention.
Figure 8:
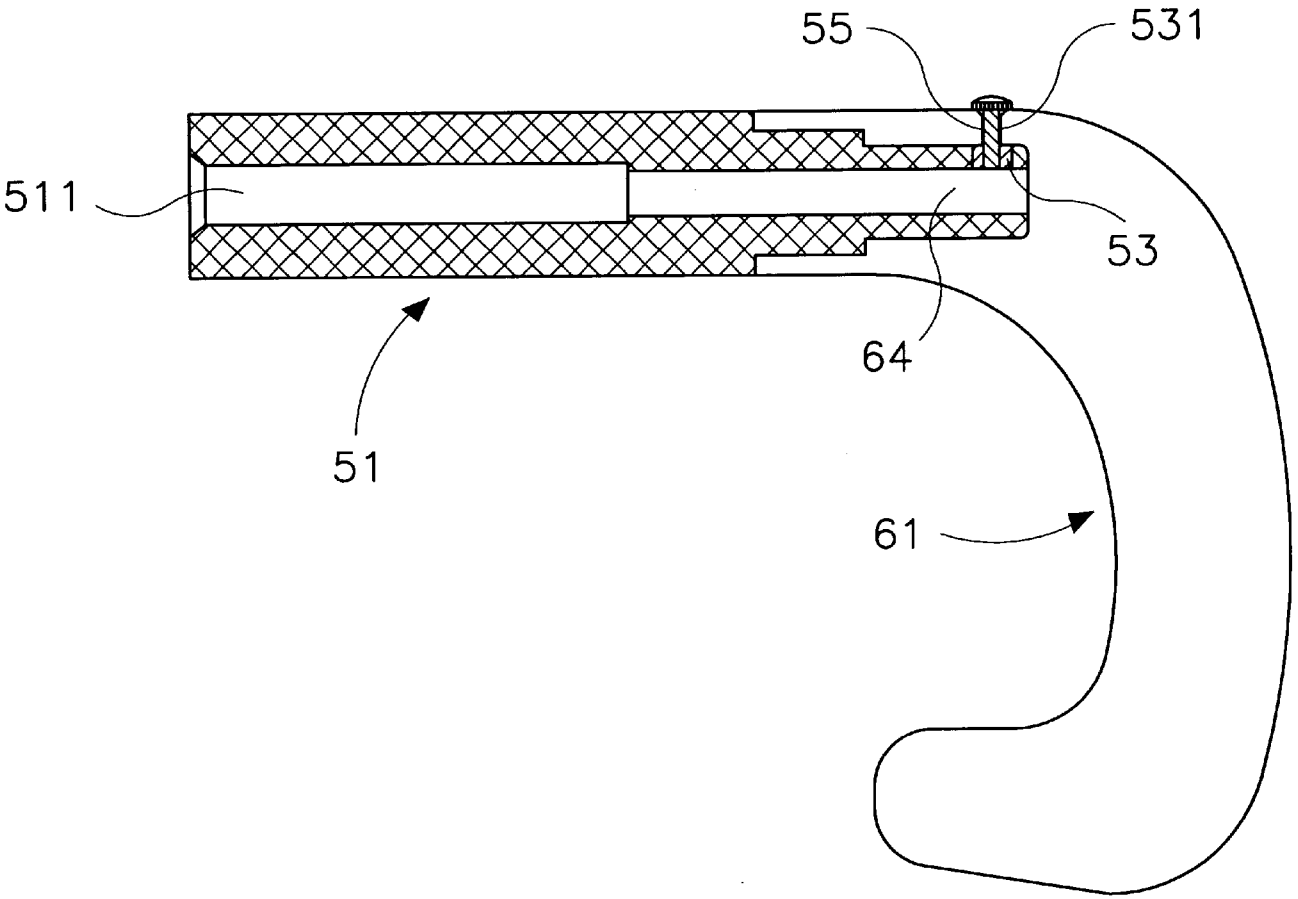
FIG. 8 is the diagram showing the connection between the shank and the handle of a stick umbrella according to an embodiment of the present invention.
Figure 9A:
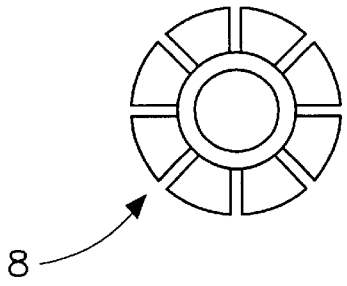
FIG. 9*a* is the front view of the connector structure I between the ferrule and the shank according to an embodiment of the present invention.
Figure 9B:
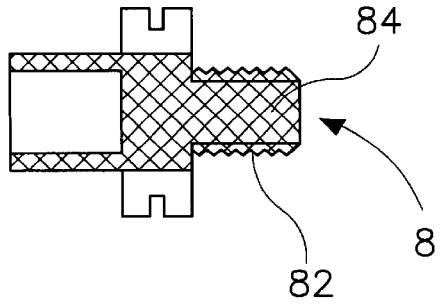
FIG. 9*b* is the side profile diagram of the connector structure I between the ferrule and the shank according to an embodiment of the present invention.
Figure 9C:
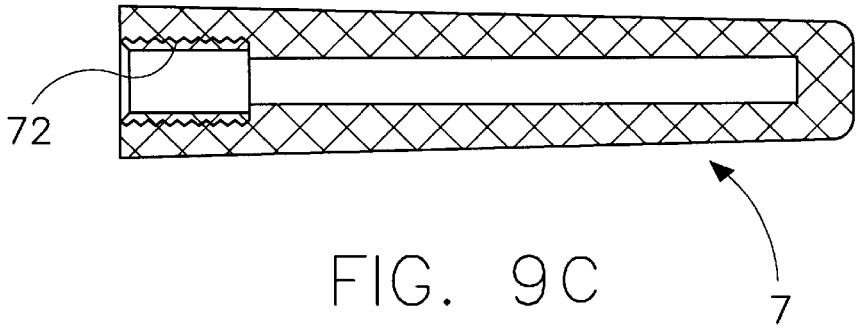
FIG. 9*c* is the profile diagram of the ferrule I according to an embodiment of the present invention.
Figure 10:
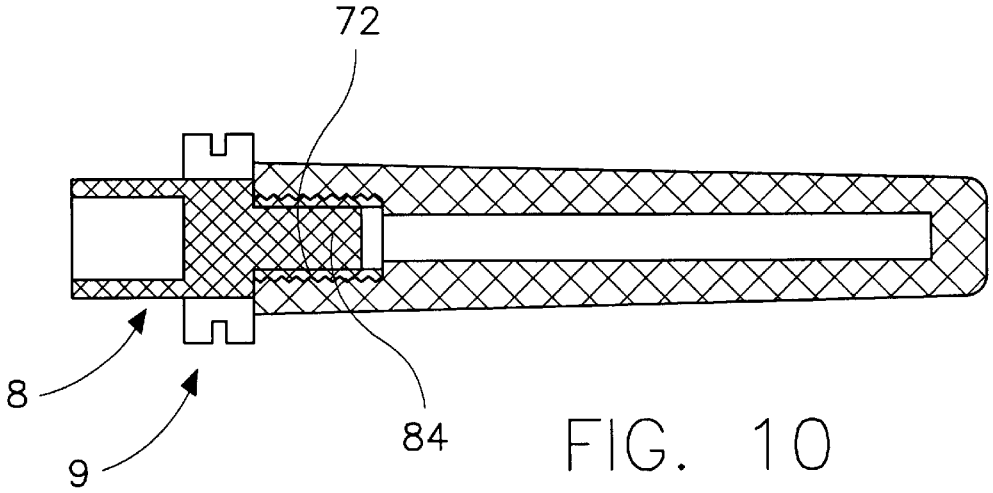
FIG. 10 is the diagram showing the connection of the connector structure I between the ferrule and the shank according to an embodiment of the present invention.
Figure 11A:
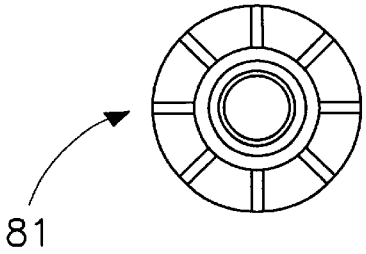
FIG. 11*a* is the front view of the connector structure II between the ferrule and the shank according to an embodiment of the present invention.
Figure 11B:
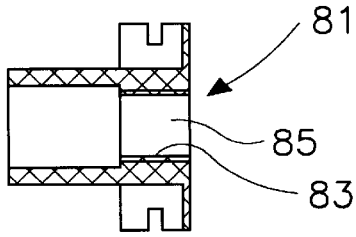
FIG. 11*b* is the side profile diagram of the connector structure II between the ferrule and the shank according to an embodiment of the present invention.
Figure 11C:
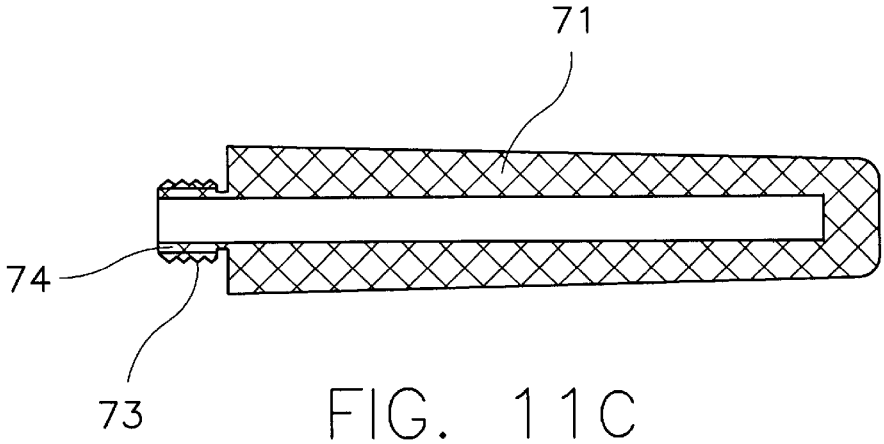
FIG. 11*c* is the profile diagram of the ferrule II according to an embodiment of the present invention.
Figure 12:
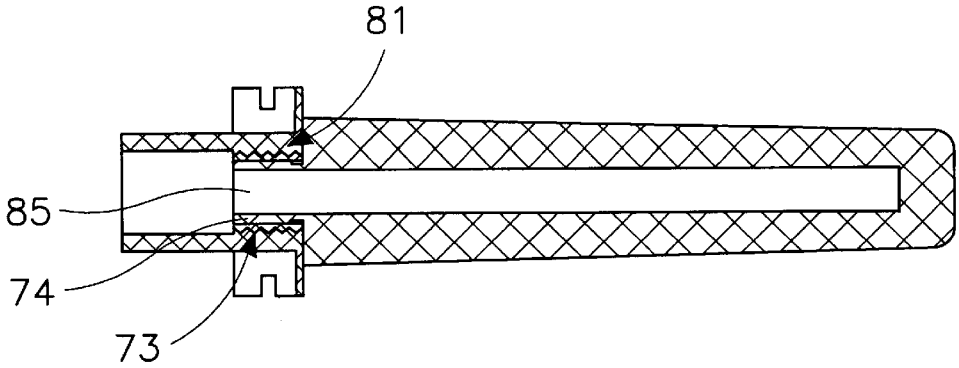
FIG. 12 is the diagram showing the connection of the connector structure II between the ferrule and the shank according to an embodiment of the present invention.

As shown in FIGS. 7*a*, 7*b*, and 8, the present invention provides an umbrella of which a connector 51 between a handle 61 of a stick umbrella and a shank has a hole 511 on one end to insert the shank for fixing it and a stair-like lock side 541 on the other end. The connector 51 has a hole 53 or a screw hole on one side of the bottom. There is another hole or another screw hole on the handle 61 of a stick umbrella to align with the hole 53 of the connector 51. The connector 51 is inserted into a mount groove 64 of the handle 61 and the lock side 541 sticks the mount groove 64. A bolt 55 or a screw is then inserted or screwed in. The handle 61 of a stick umbrella, the connector 51, and the shank can thus be positioned accurately.

As shown in FIGS. 9*a*, 9*b*, 9*c*, and 10, the present invention provides an umbrella of which a ferrule 7 has an inner thread 72 on the inner wall. The connector 8 between the ferrule 7 and the tail end of a shank forms a bump 84. The bump 84 has an outer thread on the circumference. The ferrule 7 is screwed in or locked with the connector 8. The ferrule 7, the connector 8, and the shank can thus be positioned accurately.

As shown in FIGS. 11*a*, 11*b*, 11*c*, and 12, the present invention provides an umbrella of which a bar 74 installed on the bottom of a ferrule 71 has an outer thread 73. The connector 81 between the ferrule 71 and the tail end of a shank has an open 85. The open 85 has an inner thread on the inner wall. The bar 74 of the ferrule 71 is screwed in or locked with the connector 81. The ferrule 71, the connector 81, and the shank can thus be positioned accurately.

Figure 13:
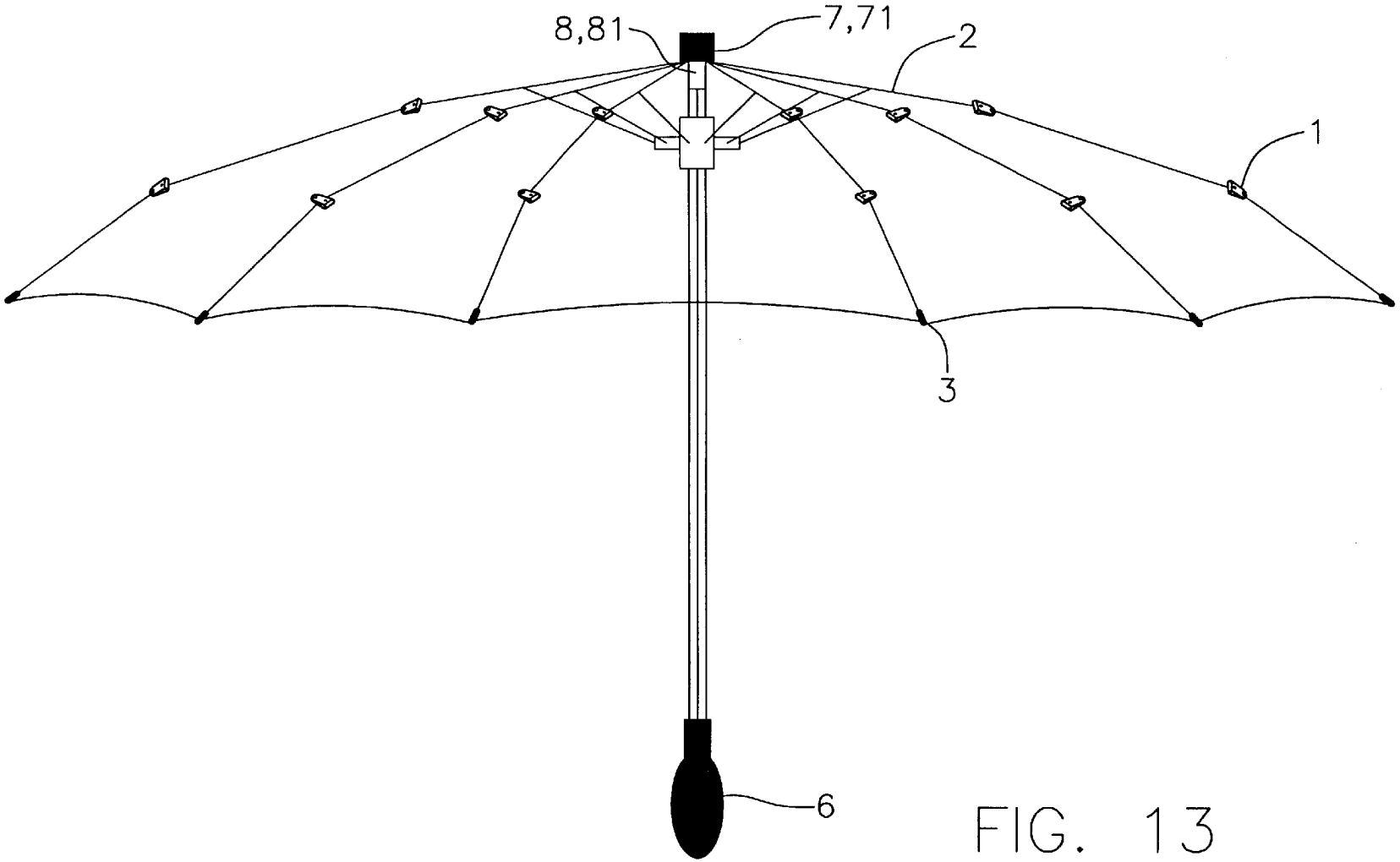
FIG. 13 is the assembly diagram of all components of the present invention.

As shown in FIG. 13, the present invention provides the user to change various shapes and colors of canopies, tip beads, handles, and ferrules to assemble new umbrellas through simple lock, insertion, or screw operation.

To sum up, the advantages of the present invention summarize:

1. The user can select various shapes and colors of handles, tip beads, ferrules, and canopies.

2. The assembly operation is simple.

3. Bad components can be replaced without need of buying a new umbrella.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. An umbrella comprising:

a longitudinally extended shank;

a first connector coupled to a first longitudinal end of said shank;

a handle releasably coupled to said first connector;

a second connector coupled to a second longitudinal end of said shank, said second connector having a threaded projection extending longitudinally therefrom;

a plurality of ribs disposed in angularly spaced relationship around said shank, each of said ribs having a first end coupled to said second connector;

a canopy overlaying said plurality of ribs;

a ferrule having a threaded opening formed in one end thereof for releasable coupling with said threaded projection of said second connector;

a plurality of third connectors disposed in angularly spaced relationship about a perimeter portion of said canopy, each of said third connectors having (a) an axially directed opening formed in a first end thereof into which a second end of a respective one of said plurality of ribs is received, (b) a hole extending therethrough in a direction transverse said axial direction for use in coupling said third connector to said canopy, and (c) a projection extending axially from a second end of said third connector;

a plurality of tip beads respectively releasably engaged to said projections of said plurality of third connectors; and, a plurality of fourth connectors coupled to said canopy in correspondence with said plurality of ribs, each of said fourth connectors being adapted to releasably engage a respective rib, whereby said handle, said canopy, said ferrule and said plurality of tip beads are replaceable.

2. An umbrella comprising:

a longitudinally extended shank;

a first connector coupled to a first longitudinal end of said shank;

a handle releasably coupled to said first connector;

a second connector coupled to a second longitudinal end of said shank, said second connector having a threaded longitudinally directed opening formed therein;

a plurality of ribs disposed in angularly spaced relationship around said shank, each of said ribs having a first end coupled to said second connector;

a canopy overlaying said plurality of ribs;

a ferrule having a threaded projection extending from one end thereof for releasable coupling with said threaded opening of said second connector;

a plurality of third connectors disposed in angularly spaced relationship about a perimeter portion of said canopy, each of said third connectors having (a) an axially directed opening formed in a first end thereof into which a second end of a respective one of said plurality of ribs is received, (b) a hole extending therethrough in a direction transverse said axial direction for use in coupling said third connector to said canopy, and (c) a projection extending axially from a second end of said third connector;

a plurality of tip beads respectively releasably engaged to said projections of said plurality of third connectors; and, a plurality of fourth connectors coupled to said canopy in correspondence with said plurality of ribs, each of said fourth connectors being adapted to releasably engage a respective rib, whereby said handle, said canopy, said ferrule and said plurality of tip beads are replaceable.

* * * * *